United States Patent [19]

Smith

[11] 3,983,600

[45] Oct. 5, 1976

[54] BY-PASSING DOOR FASCIA ASSEMBLY

[75] Inventor: James Edward Smith, Azusa, Calif.

[73] Assignee: Arthur Cox & Sons Inc., Los Angeles, Calif.

[22] Filed: Feb. 20, 1976

[21] Appl. No.: 659,699

[52] U.S. Cl. ..... 16/87 R; 160/38; 49/409; 52/717; 16/94 R; 16/95 R

[51] Int. Cl.[2] ..... E05D 13/02

[58] Field of Search ..... 16/87 R, 94 RV, 94 D, 16/93 R, 93 D, 95 R, 95 D, 96 R, 96 D; 52/122, 287, 442, 717; 160/19, 38, 39; 49/409, 410, 411

[56] References Cited

UNITED STATES PATENTS

| | | | |
|---|---|---|---|
| 2,597,578 | 5/1952 | Ganter | 160/38 |
| 2,790,197 | 4/1957 | Ganter | 16/93 D X |
| 3,007,036 | 10/1961 | Mills | 160/38 X |
| 3,247,893 | 4/1966 | Ford | 16/94 D X |
| 3,344,463 | 10/1967 | Znamirowski | 16/94 D |
| 3,699,610 | 10/1972 | Harby | 16/93 D X |
| 3,818,544 | 6/1974 | Helmer et al. | 16/94 D |
| 3,854,165 | 12/1974 | Haley | 16/94 R X |

*Primary Examiner*—Wayne L. Shedd
*Attorney, Agent, or Firm*—John E. Wagner

[57] ABSTRACT

An assembly of a track member for suspended doors designed for ceiling or door opening header mounting having a separate fascia member mechanically interlocking therewith and secured in place and laterally supported by a spring member.

10 Claims, 10 Drawing Figures

BY-PASSING DOOR FASCIA ASSEMBLY

BACKGROUND OF THE INVENTION

A very desirable form of closet for homes, offices and apartments is the by-passing door assembly which employs preferably two doors, each supported by rollers engaging a pair of parallel tracks. One door travels on each track to by-pass in front or behind each other. The double track is secured to the door header or ceiling. The double track is usually roll formed from a single piece of sheet steel having sufficient thickness and strength in general to support the weight of the doors in all normal circumstances. The track and doors are normally installed as a final construction step on the structure. It is apparent that employing by-passing doors of this type, the hanger assembly plus the track will be visible from the interior of the room unless some fascia is installed to cover the assembly. One simple approach is the use of a wooden fascia board installed and finished after the track and doors, but, as indicated above, it is desired that all finished carpentry and painting be completed before the installation of the doors.

BRIEF STATEMENT OF THE INVENTION

I have found that it is possible to design a two piece track and fascia member for by-passing doors employing a unique design clip which serves not only to positively connect the fascia member to a track but also to provide lateral support for the fascia. This invention also allows the two to be manufactured, finished and then preassembled and installed. The fascia is securely attached to the track on the job site and does not interfer with the mounting of the track. The clip member is designed to overlie the top mounting surface of the track with end hooks engaging one edge of the mounting surface of the track and in the opposite end, engaging a bottom of the track. The clip passes through holes in the fascia and it includes an elbow portion extending outward from the track and engaging the rear side on the fascia member to hold it in spaced, supported relation in front of the track.

In an alternate embodiment, the fascia is supported totally in front of the track and locked within a C shaped clamp portion of a spring member.

BRIEF DESCRIPTION OF THE DRAWINGS

This invention may be more clearly understood from the following detailed description and by reference to the drawings in which.

DETAILED DESCRIPTION OF THE INVENTION

Figure 1:
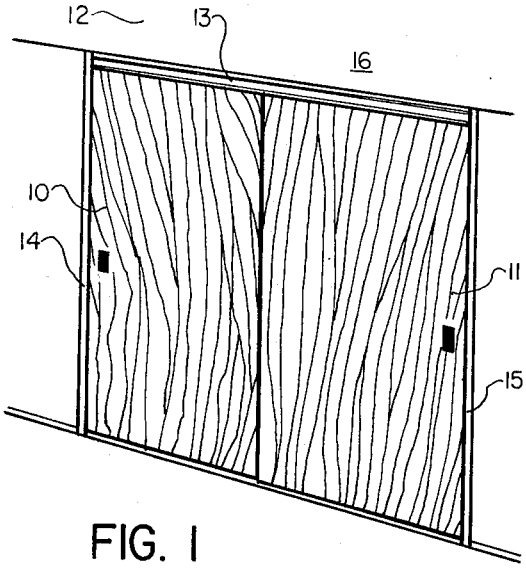
FIG. 1 is a perspective view of a fully assembled and installed by-passing door assembly employing this invention.

Now referring to FIG. 1, a typical installation of a by-passing door assembly employing this invention is illustrated. A pair of doors 10 and 11 are positioned in a door opening 12 with the door 11 by-passing in front of door 10 and both of them passing behind a fascia member 13. The two doors 10 and 11 travel between the door jams 14 and 15 and are suspended from the overhead 16, which may be either the door header or the room ceiling. The doors 10 and 11 are suspended on a track which is concealable by the fascia 13 and guided by a lower threshold which is substantially concealed by the doors 10 and 11 themselves. FIG. 1 shows the presentation of the normally closed by-passing doors to the occupant of the room in which they are installed. The fascia 13 conceals all of the track and suspension hardware and extends below the level of the top of the doors so that only the front panelling of the doors and the fascia board appear in the opening.

The details of the track and hanger assembly may be seen in the U.S. Pat. No. 3,744,827, assigned to the assignee of this invention, and the disclosure of which is incorporated by reference herein. The relationship of the fascia to the track may be seen in FIG. 2 along with the cooperation with its assembly clip hereinafter described. The track 20 is preferably made by roll forming a single sheet of steel to provide an upper support surface 21 which is used generally flat and includes a pair of continuous suspended V shaped channels 22 and 23, spaced from front to rear to allow the by-passing of doors which are hung from the channels 22 and 23. The upper surface 21 of the track 20 is generally flat except for a continuous dimple or groove 24.

Ideally, the track itself may include an integral fascia extending downward, however, the complexity of such a shape does not lend itself to practical manufacture. Likewise the metal thickness of the track assembly for supporting the doors is usually significantly greater than that required for the ornamental fascia. Also, the ornamental finish of the fascia is not required or desired on the track.

One approach has been to produce a separate fascia in the form of a generally inverted L shaped member with the foot of the L held merely by compression between the upper side of the track and the lower side of the mounting surface. This has reasonably been successful in the past where the installer installs the track and then backs the screws off and slides the foot of the L in between the track and the supporting surface. This partial removal of the installed part is not desirable in that it tends to interfere with the alignment of the track and does not insure reliability in the mounting of the track. It can be dislodged by accidental bumping to the dismay of the occupant of the room. Providing an interlocking groove and bead in the track and fascia still does not provide reliable mounting.

One other approach has been the use of a clip engaging the track and fascia member. The fascia member 13 appears in FIG. 2 as a generally inverted L cross section with the body of the L suspended vertically and ornamented by roll formed corrugations or others details, all of which are selected from the aesthetic standpoint. The fascia 13 has a foot 33 overlying the track 20.

Each end of the fascia is rolled to avoid sharp edges including the edge roll 30 on the foot 33 which is designed to rest in the groove 24 in the track 20. The fascia 13 also includes a series of slots, one of which, 31, appears in the drawing, FIG. 2. The slot 31 allows the passage of a clip 32 through the foot portion 33 of fascia 13.

The slip 32 interlocks the track 20 and the fascia 13 together securely and additionally provides support to the fascia 13. Clip 32 includes an end hook 34 which engages the edge of surface 21 of the track 20. The major length of clip 32 is straight and overlies the foot 33 of fascia 13 securely holding the edge roll 30 of fascia 13 into the groove 24. The clip 32 extends through opening 31 and bears against vertical track support portion 35 of track 20 and extends outward into contact with the rear face of the fascia 13. Clip 32 thereafter extends down to an end hook portion 36 which engages the underside of track channel 22. The clip 32 with its end hooks engaging the remote portion of the track 20 and lying along the upper surface 21 of track 20 assumes a relatively solid relationship with the track 20. By passing through the slot 31, it also fixedly engages the fascia 13 and by bearing against its end roll 30, locks the fascia 13 from inward and outward movement with respect to the track 20. The clip 32, by reason of an elbow portion 37 engaging the fascia below the junction of the foot and body of the fascia, provides support against the bending. In this particular embodiment, the elbow 37 rests against an inward corrugation of fascia 13, thereby supporting the fascia at a point of major strength. The clip 32 also is relatively small and is not noticably visible from the rear side of the fascia member 13. The clip 32 need not extend to the rear of track 20 but may hook through a slot anywhere in surface 21 of track 20 to the right or rear of groove 24.

Figure 3:
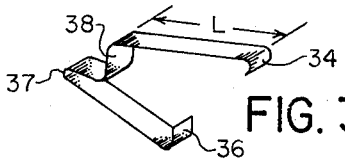
FIG. 3 is a perspective view of the assembly clip of this invention.

The details of the clip appear in FIG. 3 including the end hooks 34 and 36. The elbow 37 which engages the fascia 13, and a vertical leg 37 which passes through slot 31 of the fascia. The length L of the clip is related to the width of track 20 or the distance from the front edge of track 20 to the point of attachment which as indicated above may be a slot in surface 21.

Figure 4:
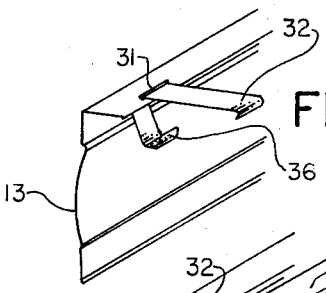
FIGS. 4 through 6 are assembly sequence drawings.
Figure 5:
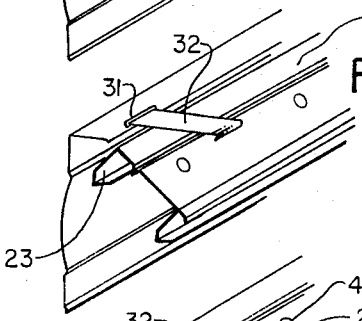
Figure 6:
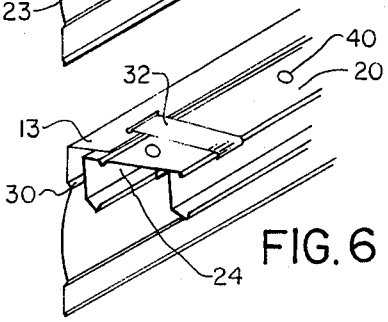

The arrangement for installation and ease which is accomplished may be understood by reference to FIGS. 4 through 6. In the assembly, the clip 32 is inserted through the slot 31 of fascia 13 with the straight portion of clip 32 in a generally horizontal position as shown in FIG. 4. Next, the track 20 is brought into engagement with the end hook 36 of clip 32 by angular introduction of the track 23 into the clip hook 36 as illustrated in FIG. 5. Thereafter, as shown in FIG. 6, the track is rotated into parallel position with the clip 32 thereby forcing the roll 30 into the groove 24 and clip end 34 over the edge of the track 20. In this view, the fascia 13 and track 20 are shown slightly exploded for clarity, however when the clip is fully engaged, the roll 30 is nestled in the groove 24. The assembly is then ready for installation which may easily be accomplished by driving screws into the overhead supporting surface through the openings to the holes 40. Thereafter, the doors may be installed. This is accomplished in a simple manner as illustrated in FIGS. 7 and 8.

Figure 7:
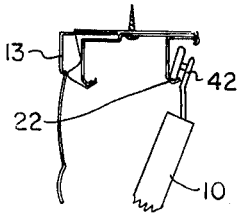
FIGS. 7 and 8 are door installation sequence drawings.

In FIG. 7, the inner door 10 is first lifted into place at an angle and its roller hanger assembly 42 brought into engagement with channel track 22. Thereafter, the door 10 may be released and allowed to swing into vertical position. The process is then repeated with the front door 11 on the front channel track 23. It is apparent by reference to FIGS. 2, 7 and 8 that the fascia 13 and the track 32 in no way interferes with the doors or their relative movement. The clip 32 also is relatively small and unobtrusive so that it does not have any adverse effect upon the aesthetics of the system while effectively locking the fascia in place and supporting it laterally.

Figure 8:
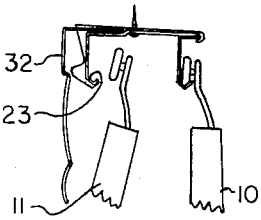

FIGS. 7 and 8 contain the doors and hangers illustrated which are of the metal framed panel insert type disclosed in our U.S. Pat. No. 3,744,827. The doors are relatively thin, e.g. ½ to ¾ inch in thickness at the edge frame.

Another common type of door is the hollow core 1 ⅛ to 1 ⅜ wooden type. When such doors are used the clearance required for the thicker doors necessitates a somewhat different clip and fascia assembly. This alternate version is illustrated in FIGS. 9 and 10.

Figure 2:
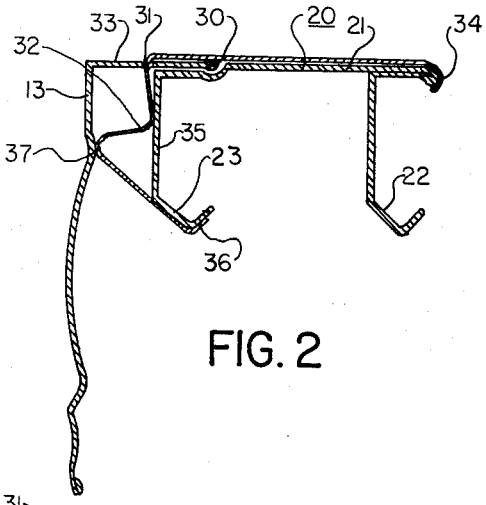
FIG. 2 is a vertical section through the fascia and track portions of the door assembly of FIG. 1.
Figure 9:
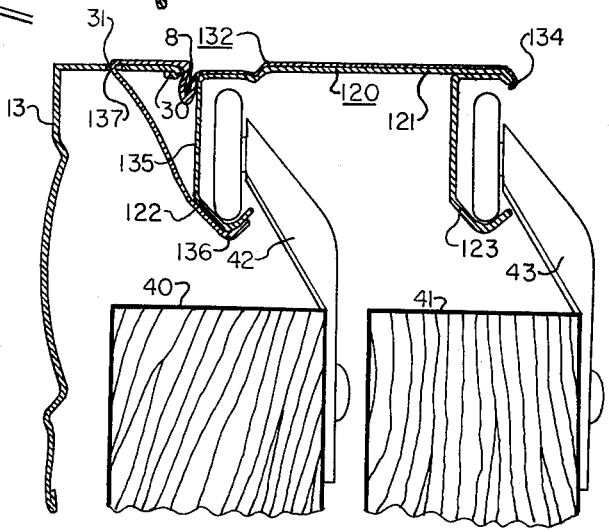
FIG. 9 is a vertical sectional view through an alternate embodiment of this invention.
Figure 10:
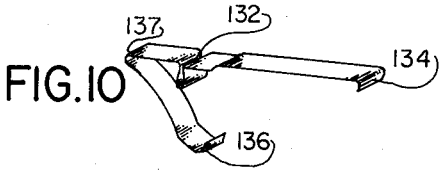
FIG. 10 is a perspective view of the clip employed in the embodyment of FIG. 9.

FIG. 9 is the equivalent of FIG. 2 assembly for use with wooden doors 40 and 41 which are illustrated in FIG. 9. The doors 40 and 41 are each suspended from track 120 by respective hangers 42 and 43 of the type disclosed in the U.S. Pat. No. 3,747,158. Track 120 is identical with track 20 except for the additional width of planer portion 121 to accomodate the thicker doors 40 and 41. Fascia 13 is identical with the element of the same reference numeral of FIGS. 1 through 8. In this case fascia 13 is supported totally in front of the track 120 by clip 132 which passes through slot 31 and includes end hooks 134 and 136 which engage respectively the edge of track 120 and the V shaped channel 122.

In this embodiment the fascia 13 is supported in a C shaped clamping space defined by a hairpin shaped bend 135 and corner bend of clip 132. The edge roll 30 of fascia 13 and the rear edge of slot 31 are securely held by clamping action of the spring clip between the bend 137 and the adjacent leg of the hairpin bend 135. This arrangement suspend the fascia ahead of the entire track 120 providing additional clearance of the front door 40. The general shape defined by hook 136, bend 37 and bend 135 is particularly rigid, characteristic of triangular structures. The triangular structure is completed by the vertical portion 135 of the track 120 and channel 122.

The above described embodiments of this invention are merely descriptive of its principles and are not to be considered limiting. The scope of this invention instead shall be determined from the scope of the following claims including their equivalents.

What is claimed is:

1. A track and fascia assembly for suspended doors comprising:

a track member including a substantially planar upper mounting surface and a depending channel portion for supporting a door therefrom;

a fascia member of generally inverted L shape including a foot portion extending parallel to the planar portion of said track and including a body portion extending downwardly, beyond and to one side of said depending channel portion of said track to provide concealment for said track from one side;

elongated spring clip means overlying the planar upper mounting surface of said track member and engaging said track member at a pair of spaced positions including said depending channel portion and engaging the foot portion of said fascia member to position the said foot portion generally parallel to said upper mounting surface of said track member.

2. The combination in accordance with claim 1 wherein the second end of said elongated clip means engages the planar portion of said track member.

3. The combination in accordance with claim 1 wherein the second end of said clip includes an end hook which engages the underside of channel portion of said track member.

4. The combination in accordance with claim 1 wherein the foot portion of said fascia member includes at least one opening therein and said clip means extends therethrough.

5. The combination in accordance with claim 1 wherein the foot portion of said fascia member overlays the planar mounting portion of said track member and said clip means mechanically baises said foot portion thereagainst.

6. The combination in accordance with claim 3 wherein said clip member includes a generally laterally extending elbow portion engaging the rear of said fascia at the apex thereof and additionally engages the depending portion of said track to provide two point support for said elbow portion and fascia.

7. The combination in accordance with claim 1 wherein said track member includes a longitudinal recess in the upper mounting surface thereof;

the foot portion of said fascia member including a portion positioned in said longitudinal recess; and said clip means overlying said foot portion to retain said fascia member in said recess.

8. The combination in accordance with claim 5 wherein said recess includes a first portion extending from the front side of said track member generally parallel to said upper mounting surface and displaced downward by a distance approximating the thickness of the foot portion of said fascia member;

wherein said planar mounting portion further includes a longitudinal groove and the foot portion of said fascia member includes a portion engaging said groove to mechanically engage said fascia member with said track member.

9. The combination in accordance with claim 1 wherein said clip means includes a generally planar length which grips the planar portion of said track member and includes a C shaped spring portion; and wherein the foot portion of said fascia member includes at least one opening therein and wherein said C-shaped spring portion of said clip extends over and in engagement with the edge of the fascia member, through and in gripping engagement with said opening and on into positive engagement with said track.

10. The combination in accordance with claim 9 wherein said C shaped clip portion extends generally parallel to the mounting portion of said track member whereby the foot portion of said fascia member extends generally parallel to said planar mounting surface of said track member.

* * * * *